US008631817B2

(12) United States Patent
Mantyla et al.

(10) Patent No.: US 8,631,817 B2
(45) Date of Patent: Jan. 21, 2014

(54) CENTRAL VACUUM INLET VALVE ASSEMBLY

(75) Inventors: James Mantyla, Barrie (CA); Andrew Bird, Shanty Bay (CA); John Ward, Midhurst (CA)

(73) Assignee: Canplas Industries Ltd., Barrie, Ontario (CA)

( * ) Notice: Subject to any disclaimer, the term of this patent is extended or adjusted under 35 U.S.C. 154(b) by 645 days.

(21) Appl. No.: 12/759,994

(22) Filed: Apr. 14, 2010

(65) Prior Publication Data

US 2011/0100485 A1 May 5, 2011

(30) Foreign Application Priority Data

Nov. 2, 2009 (CA) ..... 2685122

(51) Int. Cl.
*F16L 5/00* (2006.01)

(52) U.S. Cl.
USPC ..... 137/360; 15/301; 15/314; 220/3.3; 220/3.6

(58) Field of Classification Search
USPC ..... 137/360; 220/3.3, 3.6, 3.8, 4.02; 15/314, 301; 439/191, 192; 248/57
See application file for complete search history.

(56) References Cited

U.S. PATENT DOCUMENTS 3,036,814 A 5/1962 Stevens
3,173,164 A * 3/1965 Congdon ..... 15/314
3,335,744 A * 8/1967 Hanford ..... 137/360
3,847,175 A * 11/1974 Anderson ..... 137/360
4,336,427 A * 6/1982 Lindsay ..... 200/61.6
4,410,004 A * 10/1983 Kifer et al. ..... 137/360
4,664,457 A * 5/1987 Suchy ..... 439/192
4,688,596 A * 8/1987 Liebmann et al. ..... 137/360
4,758,170 A * 7/1988 Hayden ..... 439/142
4,927,039 A * 5/1990 McNab ..... 220/3.7
5,111,841 A 5/1992 Houston et al.
5,263,502 A * 11/1993 Dick ..... 137/360
5,349,146 A 9/1994 Radabaugh
5,578,795 A * 11/1996 Ward ..... 174/53
5,886,299 A 3/1999 Ward
7,390,206 B2 * 6/2008 Sheremeta et al. ..... 439/191
7,624,472 B2 * 12/2009 Ambrose ..... 15/314

* cited by examiner

*Primary Examiner* — John Fox
*Assistant Examiner* — Kevin Murphy
(74) *Attorney, Agent, or Firm* — Hoffmann & Baron, LLP

(57) ABSTRACT

A subassembly for use in a vacuum inlet valve assembly for a central vacuum system, the subassembly having a valve body with a wiring compartment and at least one press connection detent means and a reversible mounting flange for connecting to the valve body. The mounting flange includes an attachment portion, a mounting flange wall sized and shaped to cover an open side of wiring compartment and press catch connection elements sized and shaped to interact with the detent to secure the mounting flange to the valve body. Also disclosed is a vacuum inlet valve assembly comprising the above subassembly in combination with a cover plate having a rectangular door, a hinge located on a long side of the rectangular door, and a face plate with a vacuum connection opening. In an alternate embodiment the valve body includes a perimeter wall, attachment openings internal but adjacent to said perimeter wall and a snap fit cover to close an open wall of a wiring compartment.

11 Claims, 9 Drawing Sheets

CENTRAL VACUUM INLET VALVE ASSEMBLY

FIELD OF THE INVENTION

This invention relates to central vacuum cleaning systems, and accessories and components therefor such as inlet valves. More particularly, this invention relates to inlet valve assemblies of the type that permit hand held portable hoses with suction wands to be connected to the central vacuum system. Most particularly this invention relates to inlet valve assemblies of the type that can be adapted to include a current carrying connection for power heads of the type that are mounted at the end of the hand held suction wand.

BACKGROUND OF THE INVENTION

A central vacuum system comprises a vacuum motor and dust collecting waste receptacle, located in a remote area of a fixed dwelling, such as a garage or basement. Central vacuum systems may also be installed in mobile homes and recreational vehicles. A series of connected plastic pipes are provided throughout a building, which are connected to a plenum associated with a central vacuum motor. A series of normally closed but openable inlet valve assemblies are provided on the ends of the pipes into which a hose cuff of a flexible vacuum hose may be inserted when the inlet valve assemblies are open. The hose is portable and hand held. A hand held rigid suction wand is typically located at the free end of the vacuum hose with an appropriate dust and debris collecting nozzle. Some nozzles are electronically powered for cleaning carpets or the like and are called power head nozzles.

Typically the plastic vacuum pipes are located within the walls of a building out of sight, and a low voltage wire is strung along the pipe from the vacuum inlet valve assembly to the vacuum motor. A conductive material, such as a conductive metal ring is positioned in the insertable hose cuff located on the flexible vacuum hose. The metal ring closes a contact in a low voltage circuit which in turn activates the vacuum motor, creating suction in the pipes and in the connected vacuum hose. In this way, in some older designs, suction is automatically provided upon the hose cuff being inserted into the inlet valve assembly, or when the flexible hand held hose is connected to the in wall rigid vacuum piping system. Passing the free end nozzle of the sucking wand over loose debris will cause the debris to be sucked up into the wand, through the flexible hose, through the valve into the vacuum pipe and eventually to the dust or debris collection plenum located adjacent to the vacuum motor at the remote location such as a garage or basement.

In some cases, a higher voltage or normal household power circuit is included as part of the wiring of inlet valve assembly, typically in the form of a female electrical socket. A corresponding male connector associated with the hose cuff on the vacuum hose connects the 120 volt circuit to a power nozzle or beater bar mounted to the free end of the hand held wand for agitative cleaning of carpets or the like. The electrical connection is made upon the insertion of the hose cuff into the inlet valve assembly. A switch can be provided in the handle of the wand for turning the beater bar on or off. In most more recent designs an off/off switch can also be provided in the hand held wand or associated handle for controlled operation of the central vacuum motor. Examples of some prior art devices are disclosed in the following patents: U.S. Pat. Nos. 3,036,814, 5,111,841, 5,886,299, and 5,349,146.

Central vacuum systems are gaining in popularity for a number of reasons including: the noisy vacuum motor is located in a remote location (garage or basement) and the sound is less intense beside the user. The flexible hose is lighter to move around than a heavy vacuum motor and the only air disturbance within the dwelling is suction—there is no exhaust blowing from the vacuum unit in the room being cleaned which launches as yet un-vacuumed dust and debris into the air. For these and other reasons, central vacuum cleaner systems have been growing in popularity, both in new construction and as a retrofit installation for existing dwellings.

However, problems exist with the prior art inlet valve assembly designs. One of these problems relates to the hinged door that is used to cover the vacuum inlet when it is not in use. Often the door hinges along a top or bottom edge and is spring loaded to a normally closed position. When the door is open and the hose cuff inserted, the free edge of the door rests upon the flexible hose. As the hose is pushed and pulled across the floor to remove debris, the hose flexes which in turn flexes the door resting on the hose. Violent movement of the hose, such as flicking the hose to free it from some obstacle during vacuuming, can create large stresses in the door, causing damage. Damage to the door can lead to a loss of suction at that inlet valve assembly rendering the whole system useless until the door can be resealed. The pushing and pulling of the hose across the floor also causes the hose to rub against an edge of the door which wears a hole in the hose over time which again causes a loss of suction. What is needed is a way to reduce the potential damage to the door and the vacuum hose arising from the door resting on the vacuum hose.

Another problem arises from the use of metal components, for example for the attachment or mounting flanges. While such metal mounting flanges are highly functional, metal is expensive to use. Further the attachment flanges are typically mounted over mounting posts in a left hand or right hand manner, requiring the installer to keep on hand supplies of both left and right hand versions to satisfy the requirements for any given job. What is required is a design for lower cost component that is also more universal in application.

Another problem arises when seeking to use the mounting flanges for a retrofit installation. In new construction the mounting flange is nailed to a convenient stud and then the wall board is installed over the mounting flange. In a retrofit installation the hole in the wall board is typically too small to accommodate a mounting flange, meaning that the presence of a mounting flange leads to the requirement of a big enough hole in the existing wallboard to reveal the stud. This requires making significant repair to the opening after the mounting flange is installed and adds to the time and expense of a retrofit installation. What is desired is an inlet valve assembly that lends itself to easy and efficient use in a retrofit installation with a smaller hole in the wall to avoid excess repair.

SUMMARY OF THE INVENTION

The present invention provides a vacuum inlet valve assembly in which the basic components can be configured in various ways to suit most installation requirements. The components include a cover plate, which combines a door hinged to a face plate, a valve body, which can be used with just the cover plate in a retrofit installation or combined with a mounting flange in new construction. Each component is preferably a plastic molded part that is relatively inexpensive to make in large quantities. The valve body is designed with interlocking, inter-engaging, interference fit, or press catch connection elements to permit the mounting flange to be snap or press fit onto the valve body without requiring any special tools or the like, to form a subassembly. The subassembly can be combined with a conventional cover plate or a cover plate according to the present invention form the vacuum inlet valve assembly. The mounting flange can be positioned on the valve body in a right hand or left hand positions to suit site installation requirements. The cover plate includes a generally rectangular door which is hinged and where the door is sized, shaped and positioned to rest against a side of the vacuum hose, and most preferably against the rigid and stable hose cuff, of an inserted flexible vacuum hose when the door is biased to a closed position onto the hose when the vacuum inlet valve assembly is in use.

According to a first aspect of the present invention there is provided a subassembly for use in a vacuum inlet valve assembly for a central vacuum system, the subassembly comprising:

a valve body having a wiring compartment with an open side, a vacuum connector and at least one press connection detent means; and a mounting flange mountable to said valve body, said mounting flange having an attachment portion for mounting said mounting flange to an adjacent stud, a mounting flange wall sized and shaped to cover an open side of said wiring compartment when said mounting flange is mounted to said valve body, and press catch connection elements permitting said mounting flange to be releasably press connected to said valve body, said press catch connection elements permitting said mounting flange to be mounted in either of a right hand or a left hand position on said valve body.

According to a further aspect of the present invention there is provided a vacuum inlet valve assembly comprising a subassembly as set out above in combination with a cover plate, said cover plate having a generally rectangular door, a face plate under the door and a hinge connecting the door to the face plate, wherein said hinge is located on a longer side of said rectangular door.

According to a further aspect of the present invention there is also provided a valve body for use in a central vacuum installation being retrofit into an existing building, the valve body including a perimeter wall for abutting a cut edge of drywall; a vacuum connection opening located within said perimeter wall; an integrally formed wiring compartment with an outwardly facing open wall; a press fit cover to close said open wall, and fastener openings located within said perimeter wall to permit said valve body to be secured directly to an adjacent wall structure.

BRIEF DESCRIPTION OF THE DRAWINGS

Reference will now be made, by way of example only, to drawings depicting preferred embodiments of the invention, in which.

DETAILED DESCRIPTION OF THE PREFERRED EMBODIMENTS

Figure 1A:
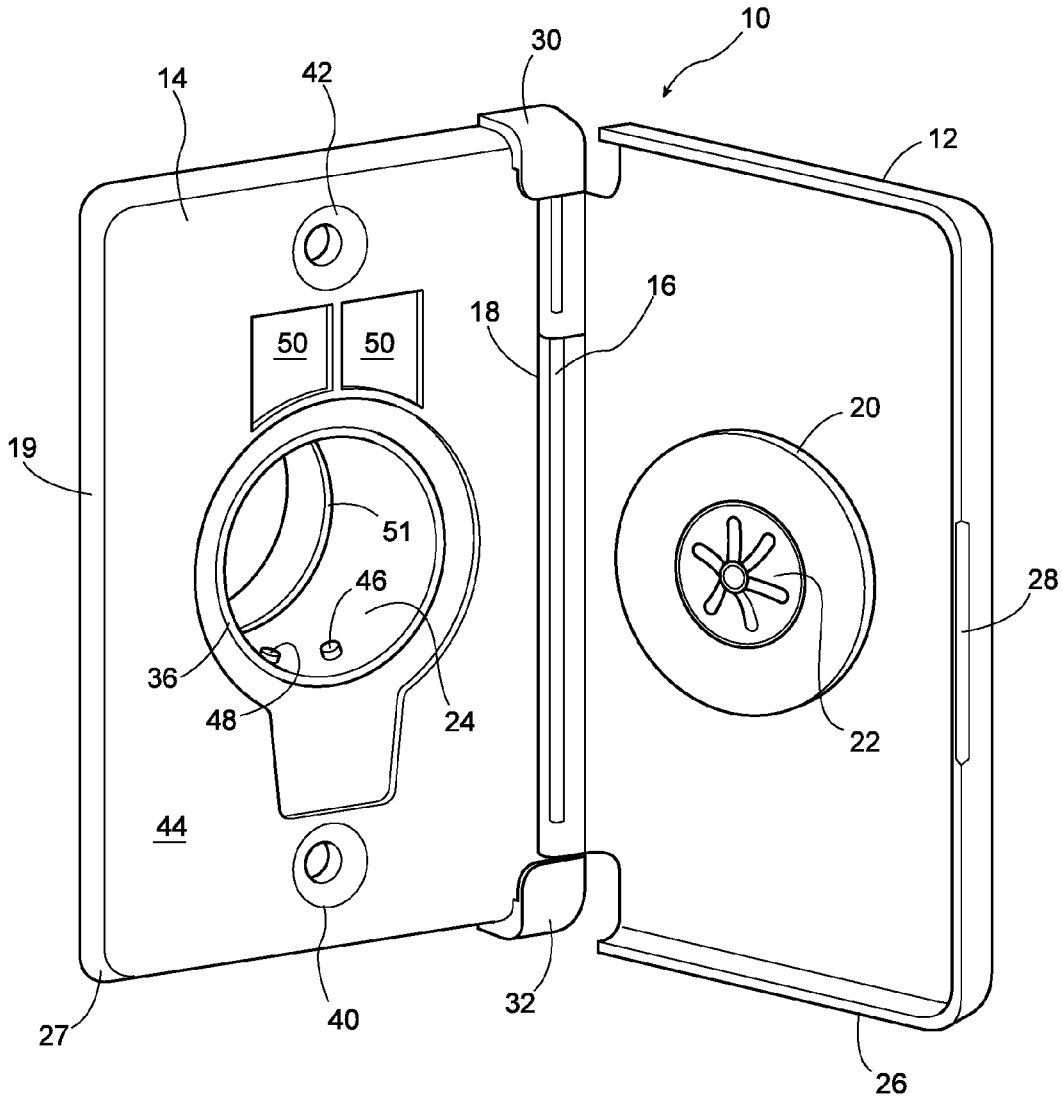
FIG. 1*a* is a front view of one embodiment of a cover plate for an inlet valve assembly according to the present invention.

The present invention is directed to an improved vacuum inlet valve assembly which is comprised of a number of elements, including a cover plate 10 with a hinged door 12, in combination with a sub assembly comprising a valve body 74 with a detachable and reversible attachment or mounting flange 70. The purpose of the vacuum inlet valve assembly is to provide an attachment point to secure a hose cuff 160 from a flexible vacuum hose 180 into a central vacuum system which inlet valve assembly can be used and easily installed in both a new construction or in a retrofit installation. This functionality is achieved by, among other things, the interrelationship of the elements of the assembly according to the present invention. Each of the elements of the preferred assembly is described in more detail below.

In FIG. 1*a* there is shown one embodiment of a cover plate 10 with a hinged door 12 according to the present invention. The hinged door 12 is attached to a face plate 14, by means of a hinge 16 located along a vertical side edge 18 of the face plate. The hinge 16 is shown on the right hand side of the face plate 14, but the present invention comprehends that the hinge could be mounted on the left hand edge 19 of the face plate 14 as desired. For example, it may be preferred to provide both right handed and left handed mountings to suit the preferences of right handed or left handed people. Most preferable the hinge will contain a spring (not shown) that is shaped and positioned to bias the door 12 to a closed position on the face plate 14.

Also shown on the door 12 is a flexible vacuum seal 20 carried on an anchor 22 in a position designed to register with a hose cuff insertion vacuum opening 24 located in the face plate 14. The seal 20 is a flexible rubber seal of the type that are well known in the art and is therefore not described in any more detail herein. A lip 26 is preferably formed around the free edges of the door 12 and fits around the edge 27 of the face plate 14. In this manner a clean seamless look is provided to the cover plate 10 when the door is closed onto the face plate 14. A gripping recess or handle 28 is provided in the lip 26 to facilitate manually gripping and opening the door 12 against the spring bias. Reinforced corners 30 and 32 are provided in the face plate 14 to improve the wear and durability of the hinge 16. As can now be appreciated the door hinge 16, being on a long side of the rectangular door is longer and stronger than if the hinge were mounted along a top or bottom edge i.e., a shorter side as in the prior art.

The face plate 14 includes the hose cuff insertion vacuum opening 24 which has a sloped valve seal seat portion 36. The valve seal seat portion 36 has two functions. It acts as a valve seal seat to allow the flexible seal 20 to be pressed into engagement with the seat by the biasing action of the door hinge 16 to close the door 12 onto the face plate 14. The flexible seal 20 is further firmly seated by means of suction in the vacuum system when the system is being accessed by an inlet valve assembly at a different location. As well the sloped valve seat portion 36 acts to help guide a hose cuff 160 being inserted into the hose cuff insertion vacuum opening 24 into position.

A pair of bevelled fastener holes 40 and 42 are also provided to secure the cover plate 10 to the rest of the inlet valve assembly as described in more detail below. Bevelling is preferred to permit fasteners to be flush to a surface 44 of the face plate 14 to permit the door 12 to close closely over the face plate 14, without hitting an end of a fastener that would otherwise be proud of the surface 44 of the face plate 14. Close fitting assists in forming a leak proof seal between seal 20 and the valve seal seat portion 36 when the inlet valve assembly is not in use. Also shown are a pair of electrical contacts 46, 48 extending into the hose cuff insertion vacuum opening 24 which may also be spring loaded in a known manner for engaging a metal or other conducive element on an inserted hose cuff 160. Such contacts 46, 48 may be connected to low voltage wire 145 and used to turn on and off a central vacuum motor in a known manner when the hose cuff 160 is inserted into the hose cuff insertion vacuum opening 24 of the inlet valve assembly. Also shown are openings 50, to permit the direct plug in of a conventional power plug to power a beater bar, power nozzle or the like attached to a free end of the wand. As well, a gasket or o-ring 51 is provided for a good vacuum seal with a hose cuff 160.

Figure 1B:
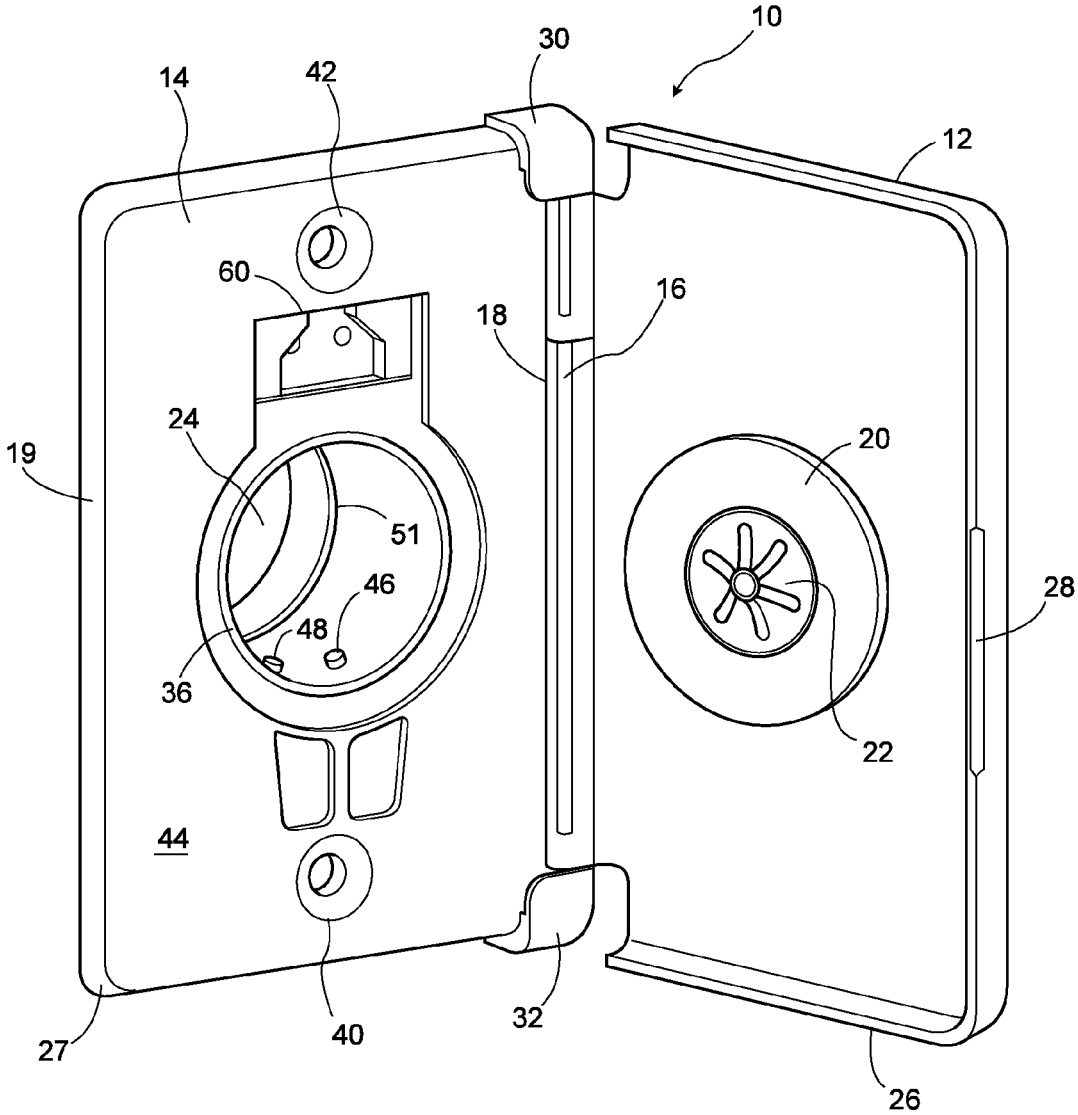
FIG. 1*b* is a front view of a second embodiment of a cover plate for an inlet valve assembly according to the present invention.

FIG. 1*b* is a view of a second embodiment of a cover plate of the present invention which is substantially similar to the cover plate of FIG. 1*a*. As such similar elements are shown with the same reference numerals as in FIG. 1*a* and the description that follows is directed to the main differences. The main difference is in the provision of an opening, for an associated two pin electrical connection in a plug opening 60 found directly above the hose cuff insertion vacuum opening 24. The plug opening 60 is sized and shaped to permit a properly shaped plug, which may be built in to the hose cuff 160 of the flexible vacuum hose 180 to be inserted into the face plate 14, to mate with a female plug located behind the face plate 14.

Figure 1C:
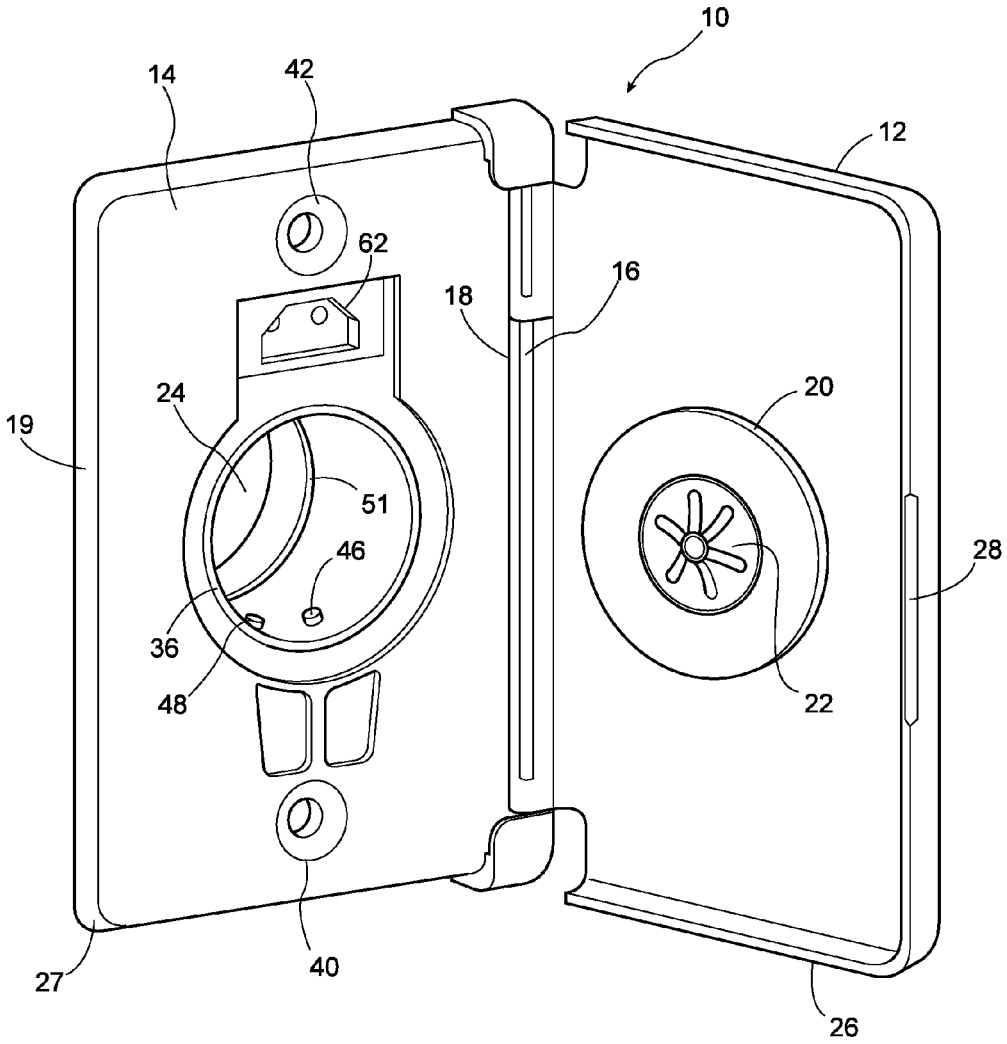
FIG. 1*c* is a front view of a third embodiment of a cover plate for an inlet valve assembly according to the present invention.

FIG. 1*c* is yet a further embodiment in which the plug opening 62 is of yet a different shape again. Otherwise the embodiments of FIG. 1*b* and is are substantially the same as FIG. 1*a*. It will be noted that the cover plates 10 of FIGS. 1*a*, 1*b* and 1*c* are interchangeable and so can be used in association with different hoses in different installations, while still being compatible with the remaining components of the present invention as described in more detail below. All of the embodiments FIGS. 1*a*, 1*b* and 1*c* of the present invention share the same overall shape and configuration of the door 12 which results in an improved durability for the cover plate doors when the system is in use, as explained in more detail below.

Figure 2:
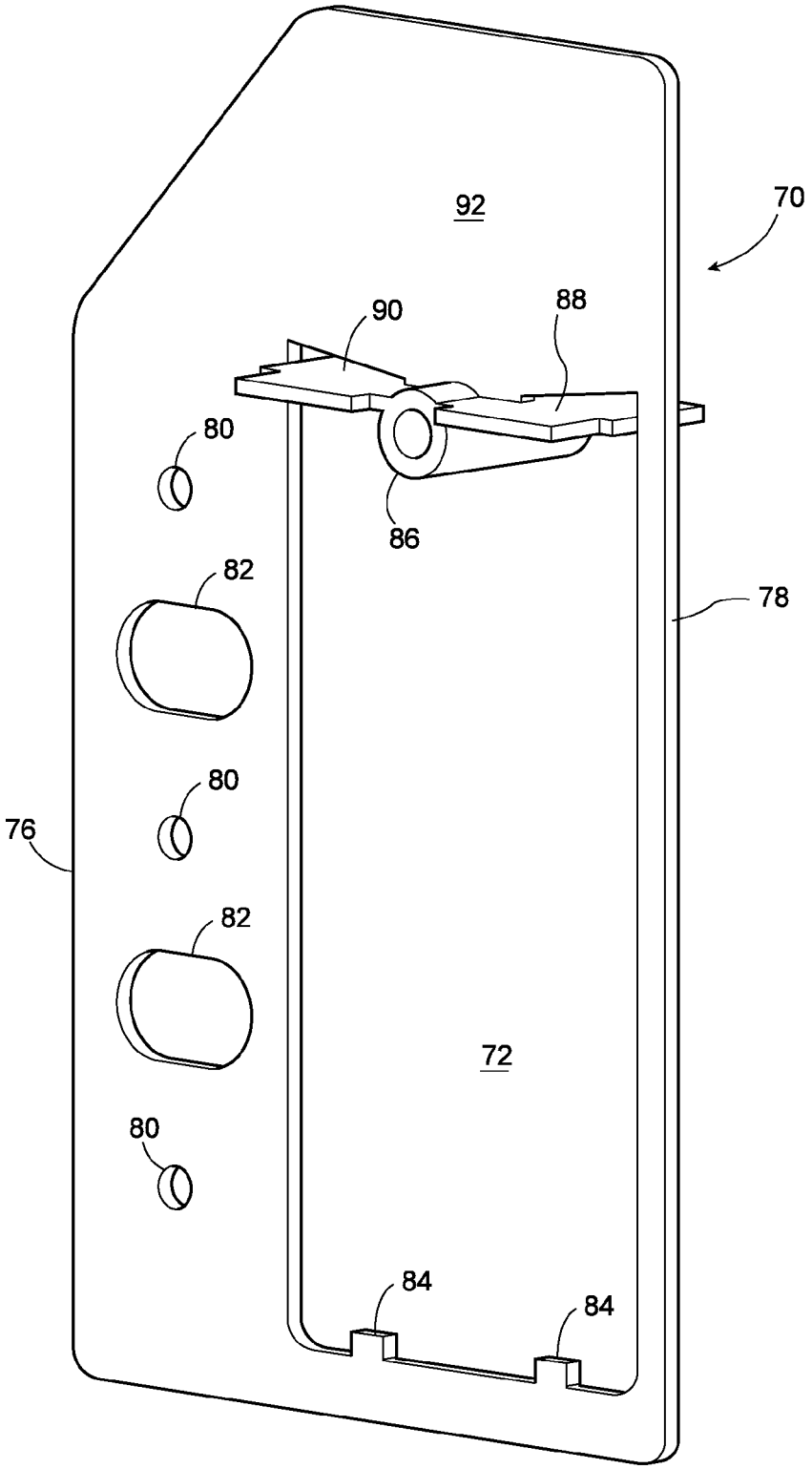
FIG. 2 is a view of a detachable mounting flange according to the present invention.

Another aspect of the present invention is a solid, rigid and reversible mounting flange 70 as shown in FIG. 2. The mounting flange 70 has an opening 72 to accommodate a valve body (shown as 74 in FIG. 3) with an attachment portion or wider side portion 76 on one side and a narrow side portion 78 on the other side. Located in the wider side portion 76 are fastener holes 80 and larger holes 82. While the pattern and location of the holes 80, 82 can vary, adequate results have been obtained with the pattern as shown. The fastener holes 80 are preferably rather small and can be used to nail or screw the mounting flange 70 to a wooden stud or the like. The larger holes 82 may also be used to help fasten the mounting flange 70 in place, but as well are material saving openings to reduce the overall need for material used to fabricate the mounting flange 70. While the mounting flange 70 can be made from a range of materials it is preferably made from molded plastic which can easily and efficiently be produced in large quantities at a reasonable cost. PVC, ABS and Polypropylene are preferred, although any readily mouldable plastic material that will meet the required fire and safety codes can also be used.

There are also some additional features of the mounting flange 70 shown in FIG. 2, located around the mounting flange opening 72. Located at the lower end of the mounting flange opening 72 are insertion tabs 84 and located at the top of the mounting flange opening 72 is an anchor tube 86 positioned generally perpendicular to the plane of the mounting flange 70 for retaining a fastener therein. Such a fastener may be used to secure the mounting flange 70 to a valve body 74 and most preferably will secure the cover plate 10 and the mounting flange 70 to the valve body 74. Also shown are a pair of opposed fastening tabs 88, 90, which assist is securing the mounting flange 70 to the valve body 74. The insertion tabs 84, in combination with the fastening tabs 88, 90 are referred to as interference fit or press catch connection elements. As can be seen there is also a mounting flange wall 92 located above the mounting flange opening 72, generally in the same plane as the flange opening 72.

Figure 3:
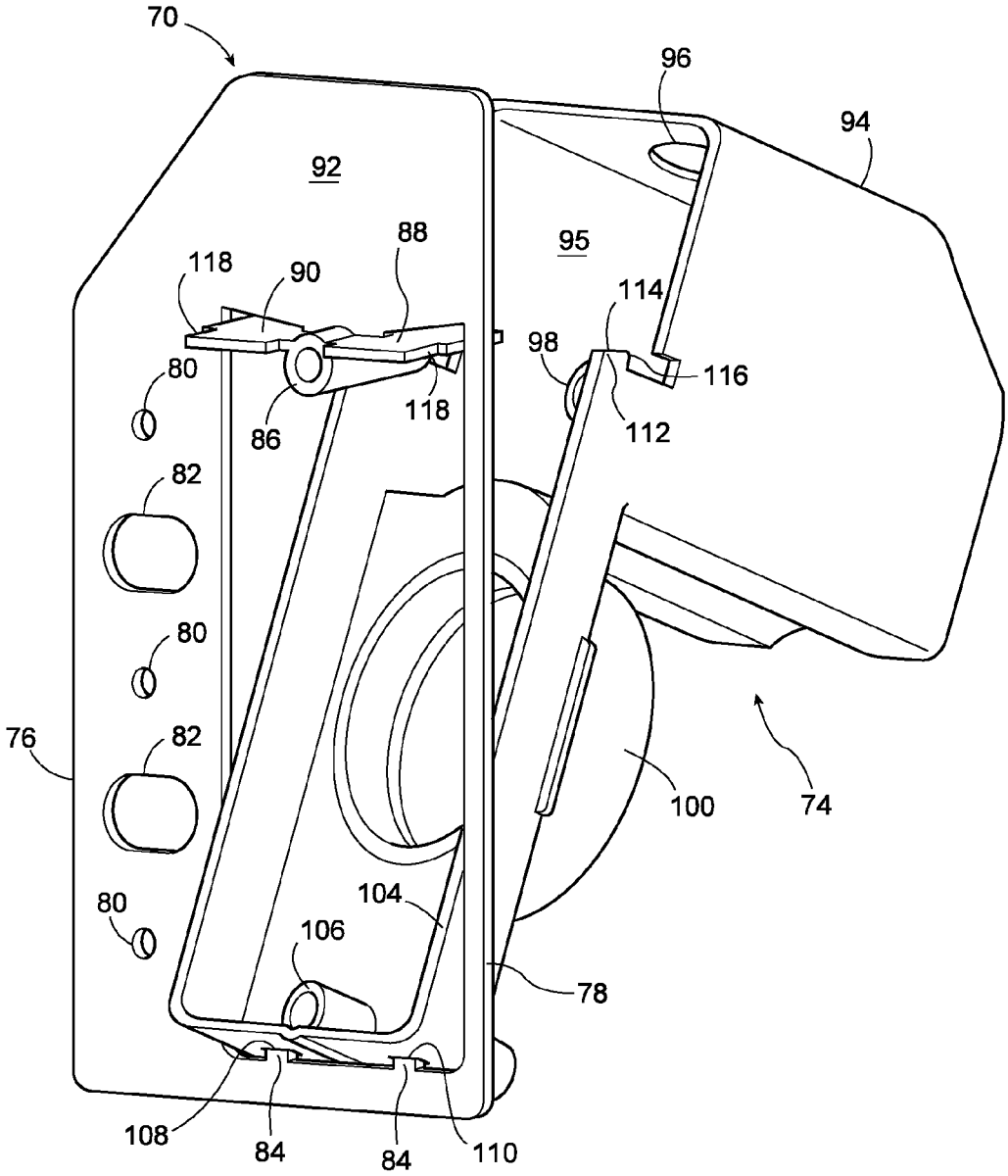
FIG. 3 is a view of the detachable mounting flange of FIG. 2 being fitted to a valve body to form a subassembly according to the present invention.

Turning now to FIG. 3, it can now be understood how the mounting flange 70 can be releasably attached to a valve body 74 to form the subassembly. As shown the valve body 74 includes an integral wiring compartment 94 with an opening 96 for a wire to be threaded through into the wiring compartment 94. The wiring compartment also includes an open wall 95, which permits easy access for wiring components together within the wiring compartment. The valve body 74 includes a fastener anchor tube 98 which is positioned to be coaxial with the anchor tube 86 when the mounting flange 70 is in position on the valve body 74. Also shown is vacuum connector 100 which can be connected in a conventional manner to vacuum piping 140, by means of an elbow 141 or the like. Inside of the vacuum connector 100 is located a rubber gasket 102 and sealing element 103 to ensure a good vacuum seal between the cover plate 10 and the valve body 74. It can now be noted that the vacuum connector 100 is located generally below the wiring compartment 94, leaving adequate room (97 in FIG. 4) to access the wiring compartment 94 and to have a pass through opening without being too cramped or crowded.

The valve body 74 includes a perimeter wall 104 which includes a further fastening anchor 106. The perimeter wall 104 is sized to abut a cut edge in a conventional building material such as drywall, for example. At an end of the valve body 74 remote from the wiring compartment 94 is located a pair of engagement openings 108, 110 into which the insertion tabs 84 are inserted, as shown. Each of the top ends of the perimeter wall 104 has a press connection decent means 112 formed at the end thereof which detent means 112 interacts with the fastening tabs 88, 90, to hold the mounting flange 70 onto the valve body 74. In particular through a press catch connection the fastening tabs 88, 90 will slide past the angled surface 114 of the detent 112, until the point 116 of the detent passes past a notch 118 on the fastening tabs 88, 90. As the other end of the mounting flange 79 is held in place by the insertion tabs 84 once the detents 112 are secured in the notches 118, the mounting flange 70 is in turn secured to the valve body 74. It can now be appreciated that the mounting flange wall 92 is sized and shaped to complete the closure of the open wall 95 of the wiring compartment 94, while leaving a wire pass through opening 97 below the fastening tabs 88, 90 for passing an electrical wire, such as a pig tail lead to the back of the cover plate 10 for a plug in type of electrical connection. When the interference fit or press catch connection is made between the mounting flange 70 and the valve body 74 the mounting flange wall 92 is closely held onto the open wall 95 in the wiring compartment 94 by the inter-engagement or interference connection of the fastening tabs 88, 90 and the notches 118 with the press connection detent means 112. At the other end the insertion tabs 84 are located in and abut the edges of the engagement openings 108, 110. As shown there are two tabs 84 at one end and two detent means 112 for two notches 118. In this manner, with four attachment points, a secure connection is achieved between the mounting flange 70 and the valve body 74, but as will be appreciated by those skilled in the art more or fewer such attachment points could be used, depending upon how secure a connection is desired. Secure closure of the wiring compartment opening 96 is desired to meet the requirements of the necessary electrical safety codes.

It can now be appreciated that the design of the interference fit or press catch connection between the mounting flange 70 and the valve body 74 of the subassembly is simple enough to be done by an installer in the field and on the fly. Thus an installer needs only to have a supply of valve bodies 74 and mounting flanges 70 at hand, and configured according to the present invention, to be able to snap fit two components together to suit either a left hand mounting on a stud or a right hand mounting to a stud depending upon the requirements of the actual field installation. In this manner duplication of inventory and potential waste is overcome and the need for an expensive metal flange component is removed. Further the interference fit or press catch connection according to the present invention can be undone with a moderate amount of non-destructive force, and without destroying the components. As a result, even if the installer makes up the subassembly incorrectly, it can be simply altered and fixed for the specific application.

Figure 4:
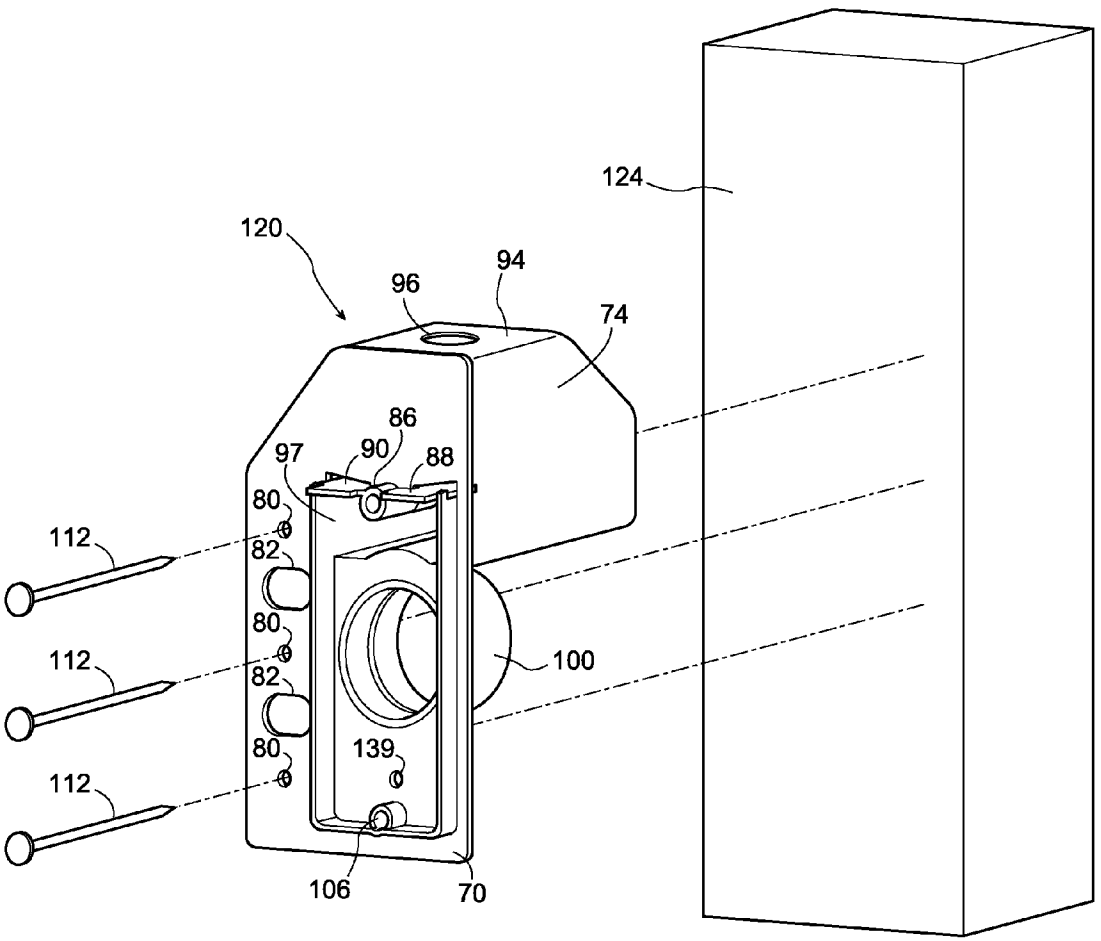
FIG. 4 is a view of the combined mounting flange and valve body subassembly of FIG. 3 being mounted to a stud of a building according to the present invention.

FIG. 4 shows the mounting flange 70 snapped together with the valve body 74 to form a subassembly 120 and fasteners 122, such as nails, being used to secure the subassembly 120 to a stud 124, through the mounting flange 70. Of course, persons skilled in the art will understand that many other fasteners, including screws for example, can be used to secure the subassembly 120. As such it will be understood that the mounting flange 70 needs to be thick enough, having regard to the material that it is made from, to be secured to the stud, without cracking.

Figure 5:
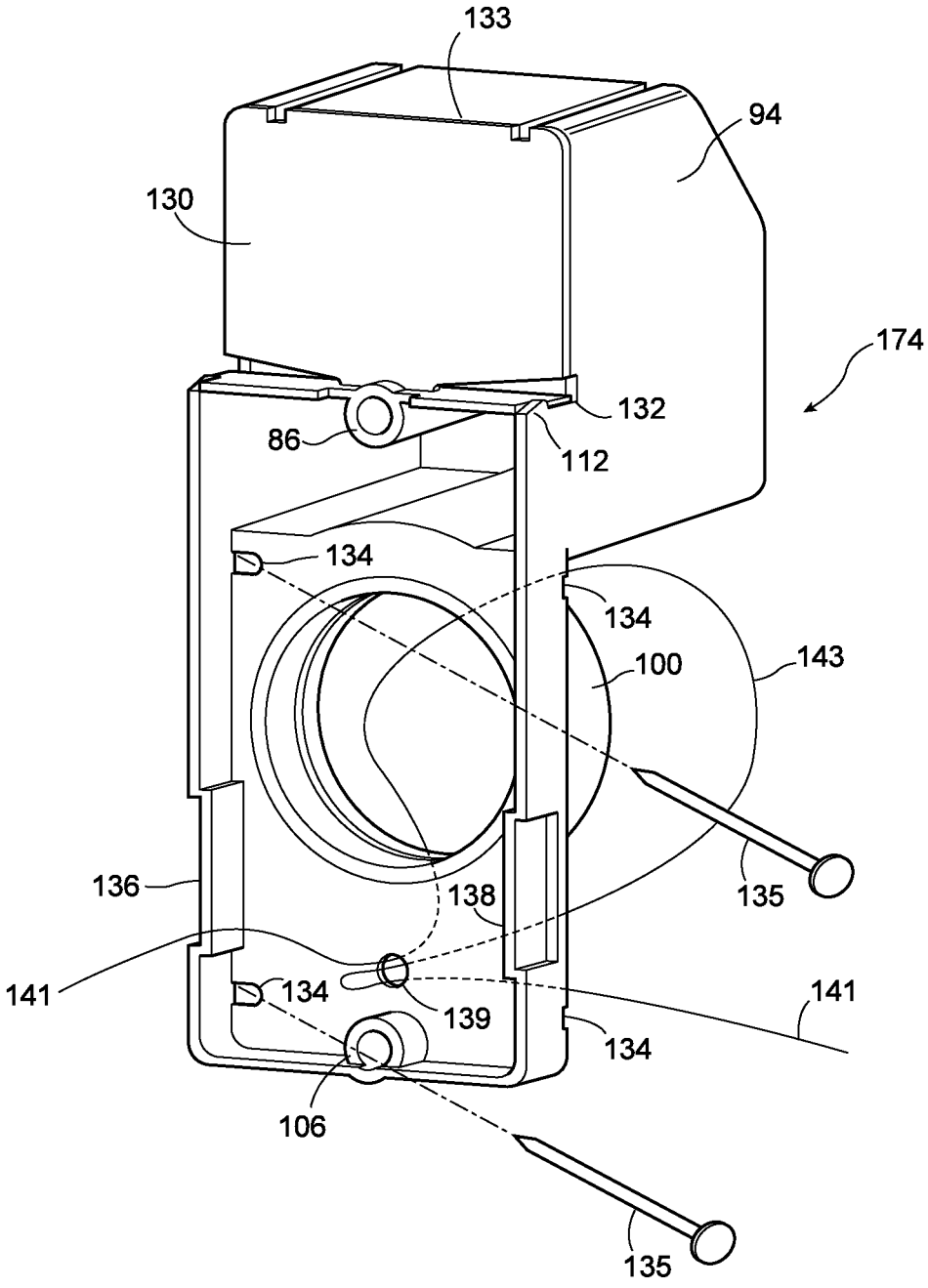
FIG. 5 is a view of a valve body subassembly according to a further embodiment of the present invention being mounted in a retrofit application.

FIG. 5 shows a further embodiment of the present invention in a retrofit application (i.e. where the wall stud is still covered with pre-existing drywall. In this case the valve body 174 does not have the mounting flange 70 attached to it, as there would be too much effort involved to expose a stud for nailing the mounting flange to. Instead, in this case the subassembly comprises a valve body 174 which includes a dedicated cover element 130 for closing the wiring compartment 94. The cover element 130 includes an integral end wall 132 which interacts with the detents 112 in a similar manner to that described above. However, in this case the underside of the cover element 130 interacts with the top edge 133 of the wiring compartment 94 to provide the leverage to make an interference fit or press catch connection. Also shown is a low voltage wire pass through hole 139 which provides a separate path through the valve body 176 through which to pass the low voltage wire 145, to keep the low voltage wire well separated from the higher voltage wires in the wiring compartment 94. The low voltage pass through hole 139 also is positioned to permit it to be used, in conjunction with the wire itself when making an elbow connection to the back of the valve body 174. More specifically by being positioned below and generally on the same axis as the vacuum connector 100 the installer can simply make a loop 143 with the low voltage wire 145, place an elbow within the loop and then use the wire loop 143 to draw the elbow into secure engagement with the vacuum connector 100 on the back of the valve body 174. In a retrofit installation it can be difficult to ensure that the vacuum piping is fully engaged with the inlet valve assembly, because of the lack of access and working space. The position of the low voltage wire pass through hole 139 can be used to assist in a secure, leak free, vacuum piping attachment according to the present invention.

As can be seen the valve body 174 is provided with fastener openings 134 to permit nails 135, for example, to be driven sideways into an adjacent stud. Four fastener openings 134 are provided so the valve body 174 can be right side or left side mounted to a stud as required for the retrofit application. Also provided are side wall indents 136 and 138 which may be used, for example to grip the valve body 174 with a pair of pliers to hold the valve body 174 in place while it is being secured to an adjacent stud with fasteners such as nails and/or screws. The side wall indents 136, 138 are most helpful where the existing hole in the drywall corresponds closely to the walled lower portion of the valve body 174 and there is no other convenient way to grip the valve body 174 during securement with nails and/or screws.

Figure 6:
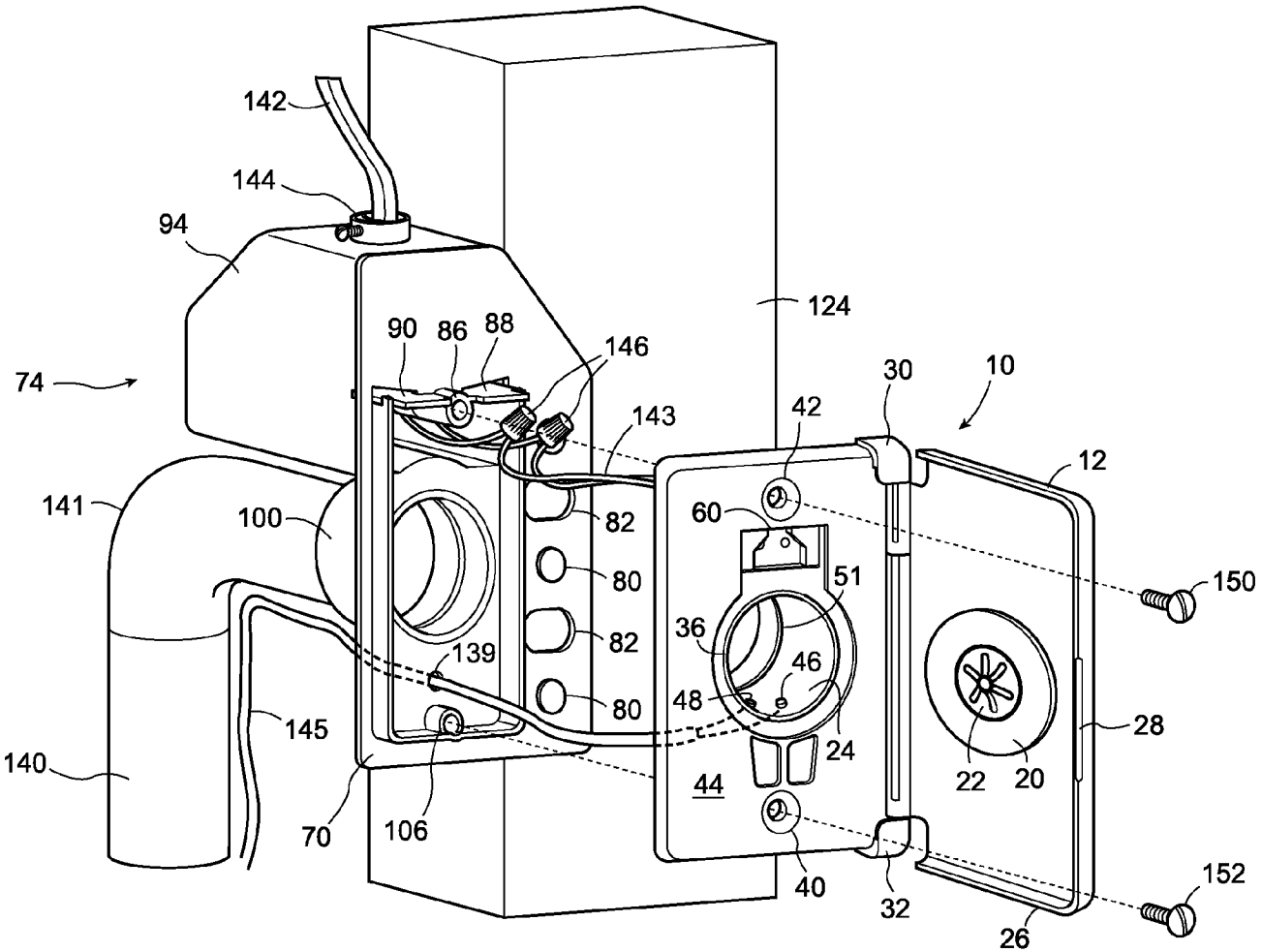
FIG. 6 is an exploded view of one embodiment of an inlet valve assembly showing how the components fit together according to the present invention.

FIG. 6 shows the complete new construction assembly of an inlet valve assembly according to the present invention, in exploded view, including a cover plate 10, and a subassembly comprising a mounting flange 70 and a valve body 74. As can be understood by looking at the drawing, this figure depicts the new construction version (i.e. where the drywall has not yet been installed leaving the stud open for easy mounting of the subassembly), not the retrofit version as the mounting flange 70 is shown attached to the valve body 74 and secured to a stud 124. The vacuum piping 140 is plumbing into the rear face of the valve body 74 and secured to the vacuum connector 100 in the usual manner with an elbow 141. A wire 142 is secured with a strain relief ring 144 above the wiring compartment 94 and is fed through the wiring compartment opening 96. A pig tail lead 143 with a female plug (not shown) is wired to the wire 142 with twist-on wire connectors 146. The female plug is mounted to the back of the cover plate 10 in a conventional manner. A pair of screw fasteners 150, 152 are shown to attach the cover plate 10 to the valve body 74, through the anchor tube 86, and fastener anchor 106.

Figure 7:
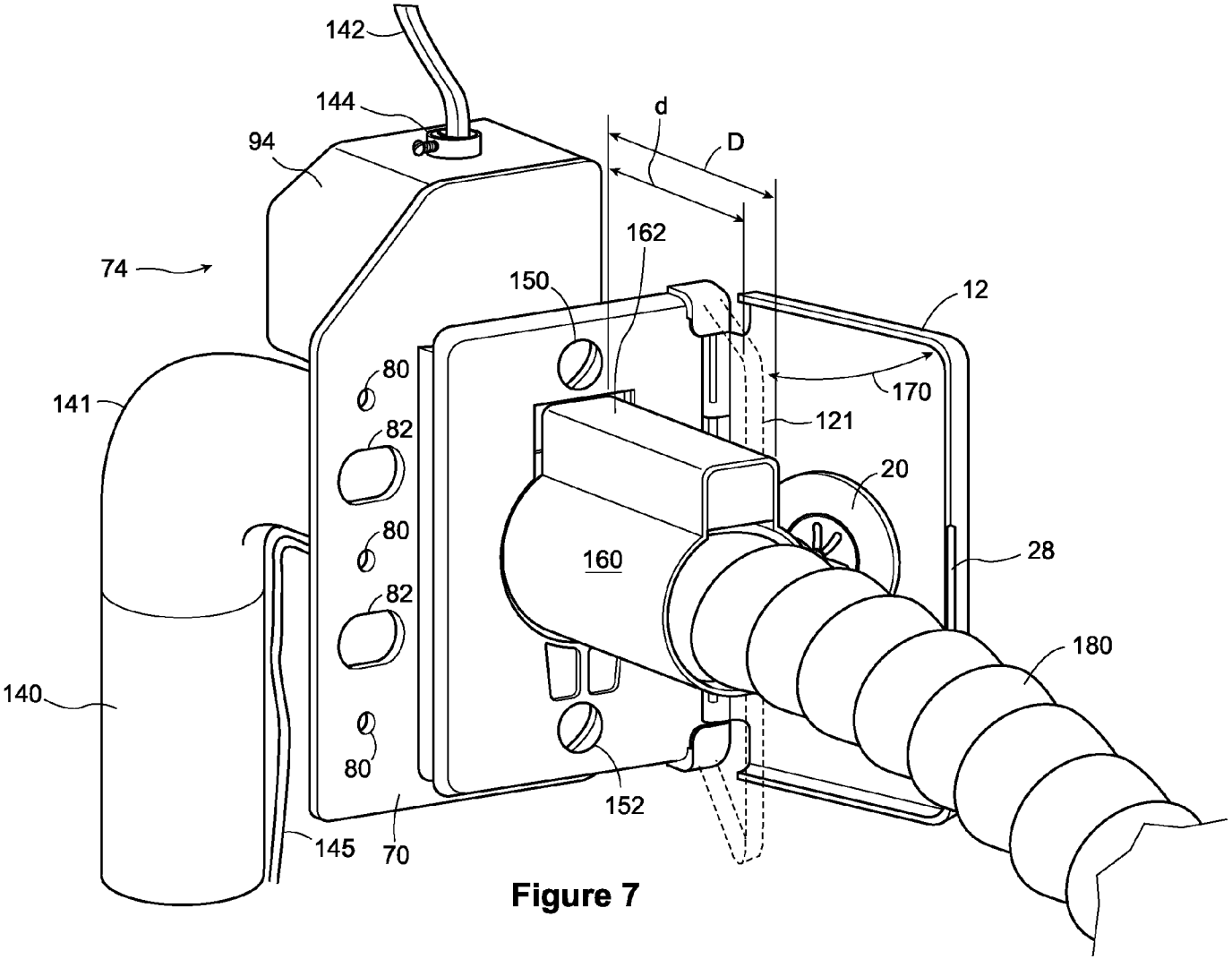
FIG. 7 is a view of the inlet valve assembly of FIG. 6 in an assembled condition according to the present invention.

FIG. 7 is a view of the components of FIG. 6 in an assembled view, with a hose cuff 160 of a flexible hand held vacuum hose 180 inserted into the cover plate 10. As shown the hose cuff 160 includes a connection portion 162 having a male plug or prongs to mate with the female plug mounted to the rear of the cover plate 10 and a flexible vacuum hose 180. As can be seen the door 12 of the cover plate 10 is open, but under the biasing influence of the spring closes along arc 170 onto the side of the hose cuff 160 as shown in dotted outline at 12'. Thus in addition to the hinge 16 being longer and stronger by being positioned along the long side of the rectangular door, orienting the door so it rests vertically against the side of the flexible hose/hose cuff means that less movement will be applied to the door by the motions of the flexible hose during vacuuming. Thus the present invention reduces wear and tear on the door and the hinge 16 during ordinary use. A most preferred configuration though is where the door rests against a portion of the solid hose cuff 160 as now explained. As can be seen that the solid hose cuff 160 extends out from the face plate 14 a distance D and the distance that the edge of the door 12 extends away from the face plate 14 at the point that it intersects the hose cuff 160 is d, which is most preferably less than D. In this manner during use, when the vacuum hose 180 is flipped around and moved back and forth, the door 12 is resting on the substantially stable and unmoving hose cuff 160 and thus is not subject to breaking or inappropriate torsional forces arising from movement of the flexible hose during normal vacuuming, unlike the top hinge designs of the prior art in which the door projects outwardly further, and is exposed to side to side hose action and thus wear. Furthermore, since the door 12 is resting on the hose cuff 160 as opposed to the vacuum hose 180, movement of the vacuum hose 180 will not wear a hole in the vacuum hose 180, as is known to occur in prior top hinge designs.

It will be appreciated by those skilled in the art that the present invention has been described with respect to preferred embodiments and that many other variations and alterations are possible with the scope of the appended claims without departing from the scope thereof. While some of these variations have been discussed above, others will be apparent to those skilled in the art. For example, the present invention comprehends both left hand and right hand mounted doors on the cover plate.

We claim:

1. A subassembly for use in a vacuum inlet valve assembly for a central vacuum system, the subassembly comprising:

a valve body having a wiring compartment with an open side, a back wall, a top wall, a bottom wall, a pair of side walls, a vacuum connector and at least one press connection detent means; and a mounting flange mountable to said valve body, said mounting flange having a body with an attachment portion for mounting said mounting flange to an adjacent stud and a mounting flange wall sized and shaped to cover said open side of said wiring compartment when said mounting flange is mounted to said valve body, said mounting flange further including press catch connection elements extending in opposite directions from said body permitting said mounting flange to be releasably press connected to said at least one press connection detent means selectively on opposing sides of said body, said press catch connection elements permitting said mounting flange to be mounted in either of a right hand or a left hand position on said valve body.

2. The subassembly as claimed in claim 1 wherein said at least one press connection detent means on said valve body includes an angled surface and a peak, wherein said angled surface diverges away from said valve body toward said peak.

3. The subassembly as claimed in claim 2 wherein said press catch connection elements include a notch, formed in a wall perpendicular to a plane of said valve body, said notch being sized, shaped, and positioned to engage said at least one press connection detent means.

4. The subassembly as claimed in claim 3 wherein said press catch connection elements further include insertion tabs for securing said mounting flange, remote from said notch, to said valve body.

5. The subassembly as claimed in claim 4 wherein said valve body further includes engagement openings to accommodate said insertion tabs and to retain said mounting flange to said valve body.

6. The subassembly as claimed in claim 5 wherein said peak is positioned relative to said notch to retain said mounting flange wall against said opening in said wiring compartment when said peak has engaged said notch.

7. The subassembly as claimed in claim 1 wherein said mounting flange is a plastic molded part.

8. The subassembly as claimed in claim 1 wherein said valve body is a plastic molded part.

9. A vacuum inlet valve assembly comprising a subassembly according to claim 1 in combination with a cover plate, said cover plate having a generally rectangular door, a face plate under the door and a hinge connecting the door to the face plate, wherein said hinge is located on a longer side of said rectangular door.

10. The assembly as claimed in claim 9 wherein said face plate accommodates a flexible vacuum hose having a hose cuff sized and shaped to be inserted into the face plate, the hose cuff being a rigid element fixed to the face plate and extending to a distance D away from the face plate, and said door pivots about said hinge and is sized and shaped whereby a free edge of said door contacts said hose cuff at a distance less than D.

11. The subassembly as claimed in claim 1, wherein said top wall comprises an opening.

* * * * *

UNITED STATES PATENT AND TRADEMARK OFFICE

CERTIFICATE OF CORRECTION

PATENT NO. : 8,631,817 B2
APPLICATION NO. : 12/759994
DATED : January 21, 2014
INVENTOR(S) : James Mantyla et al.

It is certified that error appears in the above-identified patent and that said Letters Patent is hereby corrected as shown below:

In the Specification

Column 3, line 4, replace “left hand positions to suit” with --left hand position to suit--.

Column 5, line 41, replace “FIG 1b and is are substantially” with --FIGS 1b and 1c are substantially--.

Column 6, line 51, replace “decent means 112” with --detent means 112--.

Signed and Sealed this
Twentieth Day of May, 2014

Michelle K. Lee

Michelle K. Lee
*Deputy Director of the United States Patent and Trademark Office*